US005149410A

United States Patent [19]

Robinson et al.

[11] Patent Number: 5,149,410

[45] Date of Patent: Sep. 22, 1992

[54] CATHODE STRIPPING APPARATUS

[75] Inventors: Victor E. Robinson; Stein Kristoffersen, both of Porcupine; Joseph Laezza, Timmins, all of Canada

[73] Assignee: Falconbridge Limited, Toronto, Canada

[21] Appl. No.: 598,369

[22] Filed: Oct. 16, 1990

[51] Int. Cl.[5] ..... C25D 17/00

[52] U.S. Cl. ..... 204/199

[58] Field of Search ..... 204/199, 225

[56] References Cited

U.S. PATENT DOCUMENTS 3,953,312 4/1976 Kikkawa et al. ..... 204/198

4,039,418 8/1977 Kawakami et al. ..... 204/198

*Primary Examiner*—T. M. Tufariello

*Attorney, Agent, or Firm*—Fleit, Jacobson, Cohn, Price, Holman & Stern

[57] ABSTRACT

A method and apparatus for stripping electrodeposited metal sheets from permanent cathodes comprising a rotating carousel for receiving and sequentially advancing suspended permanent cathodes having electrodeposited metal sheets to a plurality of stations about the carousel including a loading station, a hammering station for loosening the upper edges of the metal sheets from the cathodes, an opening station for stripping of the metal sheets from the cathodes, a discharge station for discharge of pairs of metal sheets, and an unloading station for removal of stripped cathodes. The pairs of stripped metal sheets preferably are bottom discharged to a vertical envelope which is rotated to a horizontal position for removal of the metal sheets. Also, preferably, every second set of a pair of metal sheets is corrugated and alternate sets of planar and corrugated metal sheets are stacked to a predetermined height and bundled to form a novel bundle of metal sheets most suitable for melting.

8 Claims, 13 Drawing Sheets

FIG. 7.
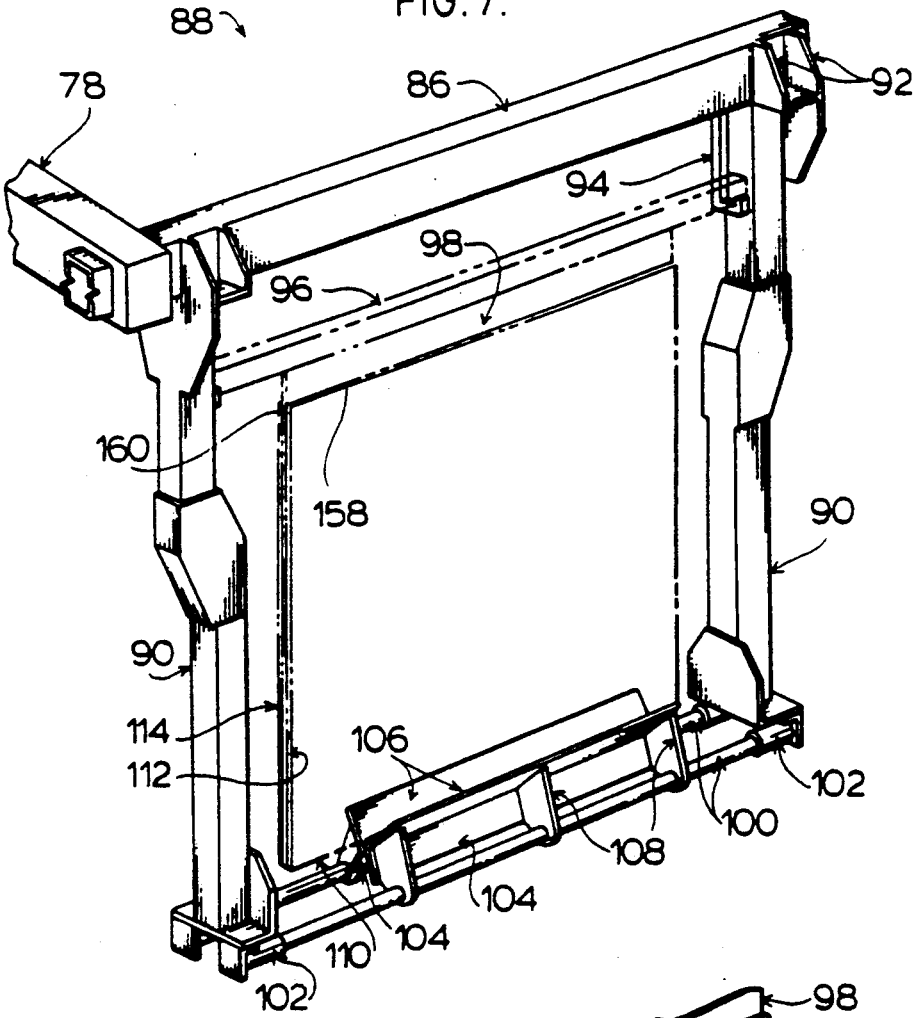
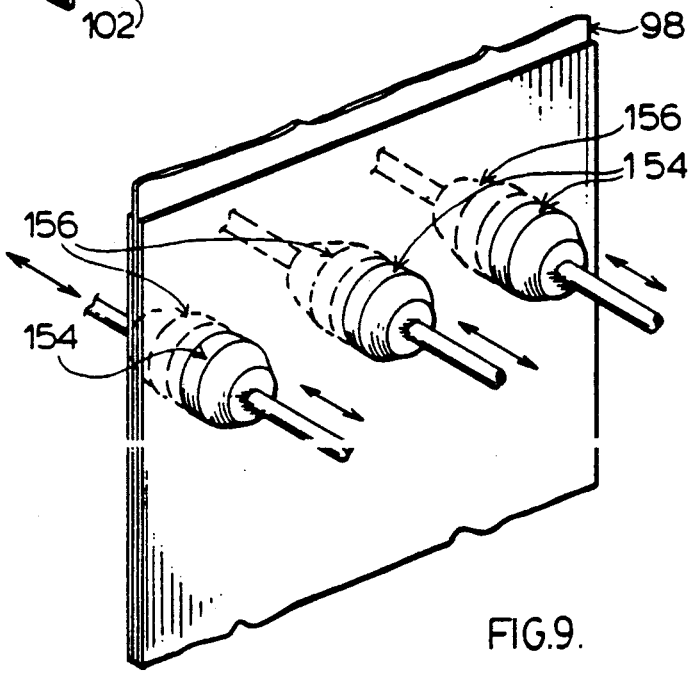
FIG.9.

CATHODE STRIPPING APPARATUS

The present invention relates to a method and apparatus for stripping electrodeposited metal sheets from cathodes, and is particularly directed to a method and apparatus for stripping electrodeposited copper sheets from stainless steel cathodes.

The stripping of electrodeposited metal sheets such as zinc or copper metal sheets from cathodes by means of mechanical stripping apparatus is well known. U.S. Pat. No. 4,039,418 granted Aug. 2, 1977 discloses an apparatus for peeling electrodeposited metal plate from a cathode including a hammering apparatus, peeling apparatus and transfer means wherein sensing and control means are provided to remove cathodes having electrodeposited metal plates remaining thereon.

U.S Pat. No. 3,953,312 issued Apr. 27, 1976 discloses an apparatus for peeling electrodeposited metal plate from a cathode by giving a mechanical impact to the upper edge of the electrodeposited metal plate to form a fine void, jetting a low pressure fluid into the fine void to separate the upper edges of the electrodeposited metal plate from the cathode, and then inserting a wedge to peel the electrodeposited metal plate from the cathode.

It is an object of the present invention to provide a stripping method and apparatus for stripping electrodeposited metal sheets from a cathode in a positive manner within a relatively small operating area, using a rotating carousel for that purpose.

SUMMARY OF THE INVENTION

The present invention is directed to the stripping of electrodeposited metal sheets from cathodes and, although the description will proceed with reference to the stripping of electrodeposited copper sheet or plate from stainless steel cathodes, it will be understood that this description is exemplary only and that the method and apparatus of the invention may also have utility in the stripping and separation of electrodeposited zinc sheets from aluminum cathodes, of nickel and cobalt sheets from cathodes and generally of electrodeposited metal sheets from permanent cathodes.

The method of the present invention relates to the stripping of electrodeposited sheets from cathodes having a hanger bar for vertical support of the cathodes on the periphery of a carousel apparatus mounted for rotation through 360° past a plurality of stations located about the periphery of the carousel and comprises the steps of feeding said cathodes sequentially at a loading station onto the carousel, rotating the carousel to transfer a cathode from the loading station to a hammering station for loosening of upper edges of the electrodeposited sheets from the cathode, rotating the carousel to transfer said cathode to an opening station for stripping of the electrodeposited sheets from the cathode, rotating the carousel to transfer the cathode to a discharge station for discharging the stripped sheets, and rotating the carousel to transfer the stripped cathodes to an unloading station for removal of said stripped cathodes.

The upper edges of the electrodeposited sheets are loosened at the hammering station by clamping the upper end of the cathode and by striking the electrodeposited sheets on the cathode in a random pattern in proximity to their upper edges from opposite sides of the cathode.

Gaps are formed between the upper edges of the electrodeposited sheets and the cathode at the opening station by flexing a central portion of the cathode laterally in a first direction to create a gap between an upper edge of an electrodeposited sheet and the cathode and inserting at least one finger in said gap, and flexing the cathode laterally in the opposite direction to create a gap between the upper edge of the other electrodeposited sheet and the cathode and inserting at least one finger in said gap, and retracting said fingers from the cathode to strip the electrodeposited sheets from the cathode. If, at this stage, the separation of the sheets from the cathode is not complete, it can be completed at another cathode is not complete, it can be completed at another full-opening, station by feeding each of the partially stripped sheets between a pair of stripping fingers which engage the upper edges of the sheets and, upon retraction from the cathode, fully strip the sheets from the cathode. Furthermore, completion of stripping may be ensured for thin sheets by providing a separation station after the opening or full-opening station wherein the upper end of the cathode is secured and a pair of opposed stripping knives are lowered between the sheets and the cathode to complete stripping from the cathode. It was found, however, that in most cases the full-opening station and the additional separation station are not required as the complete stripping operation is usually readily performed at the opening station.

A passive guide extending to the next station may be interposed between the electrodeposited sheets and the cathode to prevent the sheets from returning to rest against the cathode if they were only partially stripped, and a second passive guide extending to the next station is positioned exterior to the electrodeposited sheets to restrain the said sheets from excess lateral movement when the sheets are completely freed from the cathode.

The apparatus of the invention for stripping electrodeposited metal sheets from cathodes comprises, in combination, a carousel mounted for rotation through 360° having means for supporting and sequentially advancing cathodes to a plurality of stations located about the periphery of the carousel. The stations will normally include a loading station for receiving cathode plates having electrodeposited sheets thereon, a hammering station for loosening the upper edges of the said metallic sheets from the cathodes, an opening station for gripping the loosened upper edges of the said metallic sheets and forming a gap between the said loosened upper edges and cathodes as well as inserting retractable fingers in said gaps and stripping of the metallic sheets from the cathodes by retracting said fingers, a discharge station for discharge of pairs of metallic sheets, and an unloading station for removal of stripped cathodes.

The carousel is multi-sided and the means on the carousel for supporting the cathodes each comprises a pair of downwardly extending side arms spaced apart to receive a cathode therebetween secured to the carousel at each of the sides, a hanger bracket secured to each side arm in proximity to its upper end for supporting the hanger bar of a cathode, a V-support having an apex secured at opposite ends to the lower ends of the pair of side arms below the bottom of a cathode, and means for opening the V-support. Each of the hanger brackets is L-shaped and has a slight recess formed in a lower horizontal portion of the L to receive the cathode hanger therein.

Each V-support comprises a pair of spaced-apart, parallel rods rotatably mounted in the lower ends of the pair of side arms, and a pair of opposed plates, one of which is secured to one of each of said rods, to define a V-shape therebetween in a closed position, and means to rotate said bars and the plates secured thereto to separate said plates into an open position.

The hammering station comprises a pair of opposed, reciprocally mounted carriages, each having a plurality of air hammers, one on each side of the cathode, adapted to be extended towards and retracted away from the cathode whereby the air hammers strike the electrodeposited sheets in a random pattern in proximity to upper edges of said sheets for loosening of said upper edges. The carriages carry upper support means which rigidly abut the cathode above the electrodeposited sheets and lower support means which rigidly grip the electrodeposited sheets below the air hammers.

The opening station comprises a pair of opposed, reciprocally mounted carriages on each side of the cathode each having an upper clamp for abutting the cathode above the upper edge of the electrodeposited sheet and a lower clamp for abutting the electrodeposited sheet in proximity to its lower edge, a central push bar having a piston-cylinder assembly operatively connected thereto for independent actuation and at least one downwardly depending finger pivotally mounted at the top of the carriage, whereby the cathode can be rigidly clamped between the upper clamps and the electrodeposited sheets in proximity to their lower ends clamped by the lower clamps upon extension of the carriages towards each other. The cathode is flexed in a first direction by extending a first push bar to form a gap between the upper edge of the electrodeposited sheet and the cathode on the opposite side of the cathode and insertion of at least one finger into said gap, and then flexed in the opposite direction by retracting the first push bar and extending the second push bar to form a gap between the upper edge of the electrodeposited sheet and the cathode on the other side of the cathode with insertion of at least one finger into said gap. The second push bar and the carriages are retracted so that the fingers inserted between electrodeposited sheets and the cathode will at least partially and usually completely strip the electrodeposited sheets from the cathode.

An elongated arcuate passive guide may be mounted to extend from the opening station to the next station between each of the upper edges of the electrodeposited sheets and the cathode to prevent said upper edges from returning to rest against the cathode if they are only partially stripped. Also, an elongated arcuate passive guide is mounted to extend between the opening station and the next station to support the electrodeposited sheets in the event the sheets are completely freed from the cathodes, as is commonly the case.

An optional, full-opening station comprises a pair of opposed, reciprocally mounted carriages on each side of the cathode each having a pair of downwardly depending, spaced-apart fingers for receiving and engaging a partially-stripped upper edge of an electrodeposited sheet therebetween, and means for retracting said carriages with depending fingers for stripping of the electrodeposited sheets from the cathode if they have not been completely stripped in the opening station.

A separation station may also be located between the full-opening station and the discharge station to ensure completion of stripping of electrodeposited metal sheets from the cathodes prior to discharge. The separation station comprises means for securing the upper end of the cathode and a pair of opposed stripping knives, one on each side of the cathode, for completion of stripping of electrodeposited sheets from the cathode by lowering the knives between the electrodeposited sheets and the cathode. Such station will be required only on rare occasions and normally it is unnecessary.

The discharge station is a bottom discharge station having an envelope for receiving pairs of vertically-disposed metallic sheets, for rotating said pairs of vertical metallic sheets to a horizontal position, and for discharging said pairs of metallic sheets horizontally from the carousel.

More particularly, the discharge station comprises an envelope positioned below the cathode for receiving the pair of stripped electrodeposited sheets, means for pushing the sheets into loose vertical abutment alignment against the cathode, and means for actuating the opening means for the V-support whereby the electrodeposited sheets drop by gravity into the envelope, means for rotating the envelope into a substantially horizontal position, and ejection means for discharge of the substantially horizontal stripped sheets from the envelope.

A corrugating press preferably is provided for corrugating alternate pairs of stripped metal sheets and a stacker is provided for stacking said pairs of metallic sheets in alternating pairs of planar and corrugated metal sheets to a predetermined height, and bundling said stacked sheets into a bundle.

BRIEF DESCRIPTION OF THE DRAWINGS

An embodiment of the apparatus of the invention will now be described with reference to the accompanying drawings, in which:

FIG. 7 is a perspective view of a cathode hanger assembly showing a cathode with a metallic sheet deposited thereon in ghost lines;

FIG. 9 is a perspective view illustrating the operation of opposed hammers at the hammering station depicted in FIG. 8;

DETAILED DESCRIPTION OF THE PREFERRED EMBODIMENT

Figure 1:
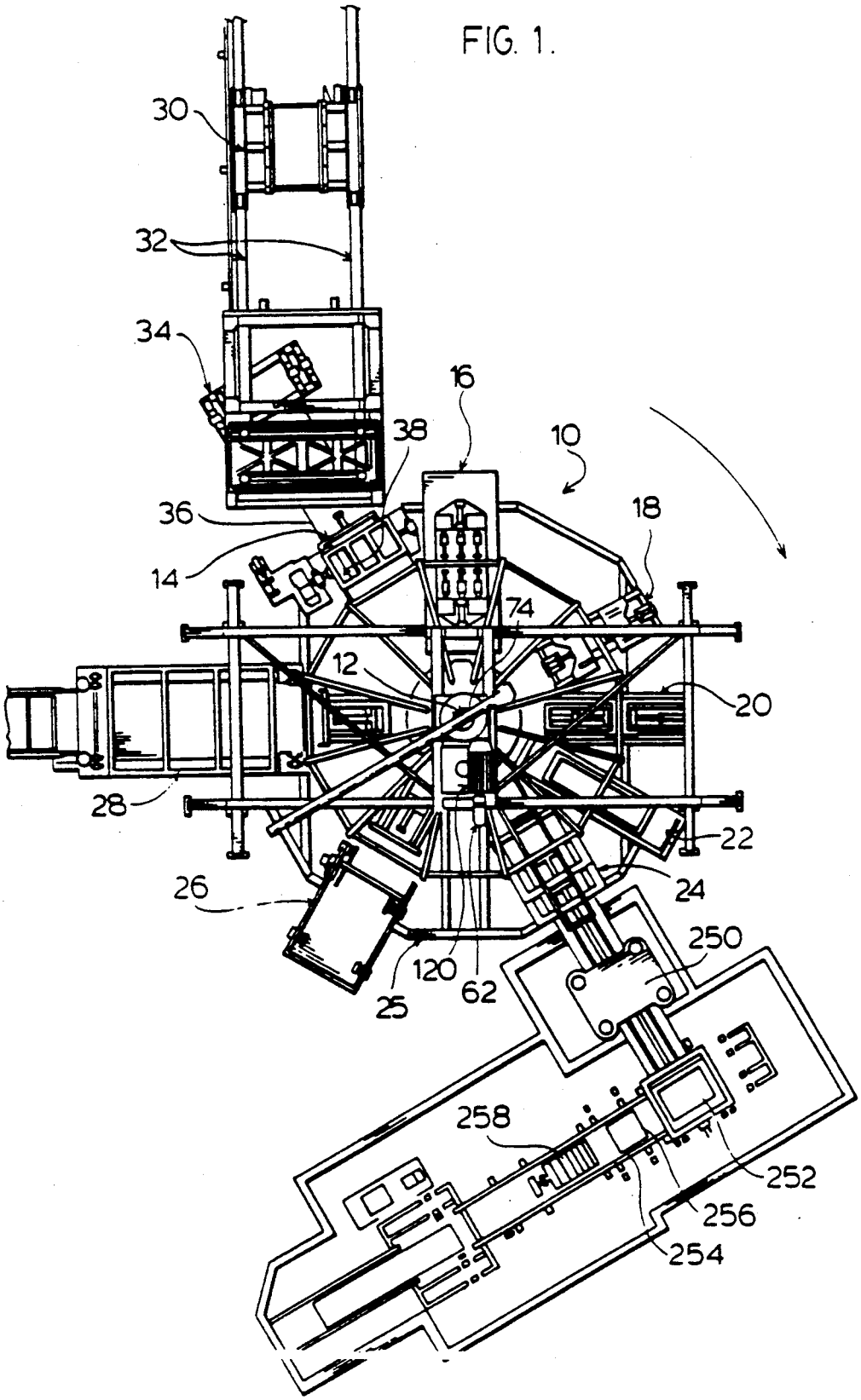
FIG. 1 is a plan view of the carousel apparatus of the invention showing the cathode feed system and discharge system.

With reference to FIG. 1 of the drawings, the apparatus for stripping metal sheets from cathodes generally comprises a multi-sided carousel 10 having, in the embodiment illustrated, 12 sides, rotated about central support shaft 12 to convey cathodes having electrodeposited metal sheets on opposite sides thereof in a clockwise direction as viewed in FIG. 1 sequentially past a number of station locations. The stations in this particular embodiment include loading station 14, hammering station 16, opening station 18, full-opening station 20, separation station 22, discharge station 24, inspection station 25, cathode exchange station 26 and cathode unloading station 28.

A load of cathodes bearing electrodeposited metal sheets, after washing, is loaded onto a carrier car 30 mounted for reciprocal travel on the top rails 32 of a transporter frame for transportation of the bundle to rotating and lowering transfer assembly 34. The bundle of cathodes, usually containing 44 cathodes, is rotated through about 30° by rotating and lowering assembly 34 onto chain conveyor depicted by numeral 36. A complete bundle of cathodes is deposited on chain conveyor 36 which advances the bundle towards loading station 14. An overhead walking beam 38 picks up a cathode for advancement onto a fixed beam with repeat of this motion until the cathode is transferred onto the hanger of the carousel at loading station 14 for sequential advancement through each station for eventual discharge of stripped sheets from discharge station 24 and removal of stripped cathodes at cathode unloading station 28.

CAROUSEL ASSEMBLY

With particular reference now to FIGS. 2–6, the carousel 10 comprises a support frame 50 having rigid steel structural corner posts 52, diagonal reinforcing gussets 54 bolted or welded to lateral beams 56, and longitudinal beams 58. Rectangular transverse beams 60, shown most clearly in FIGS. 3 and 4, support drive assembly 62. Upright central shaft 70 is mounted at its lower end on base 72 having a bearing, not shown, for rotation thereon and is supported at its upper end by bearing 74 mounted in housing 76 supported by transverse beams 60.

Figure 2:
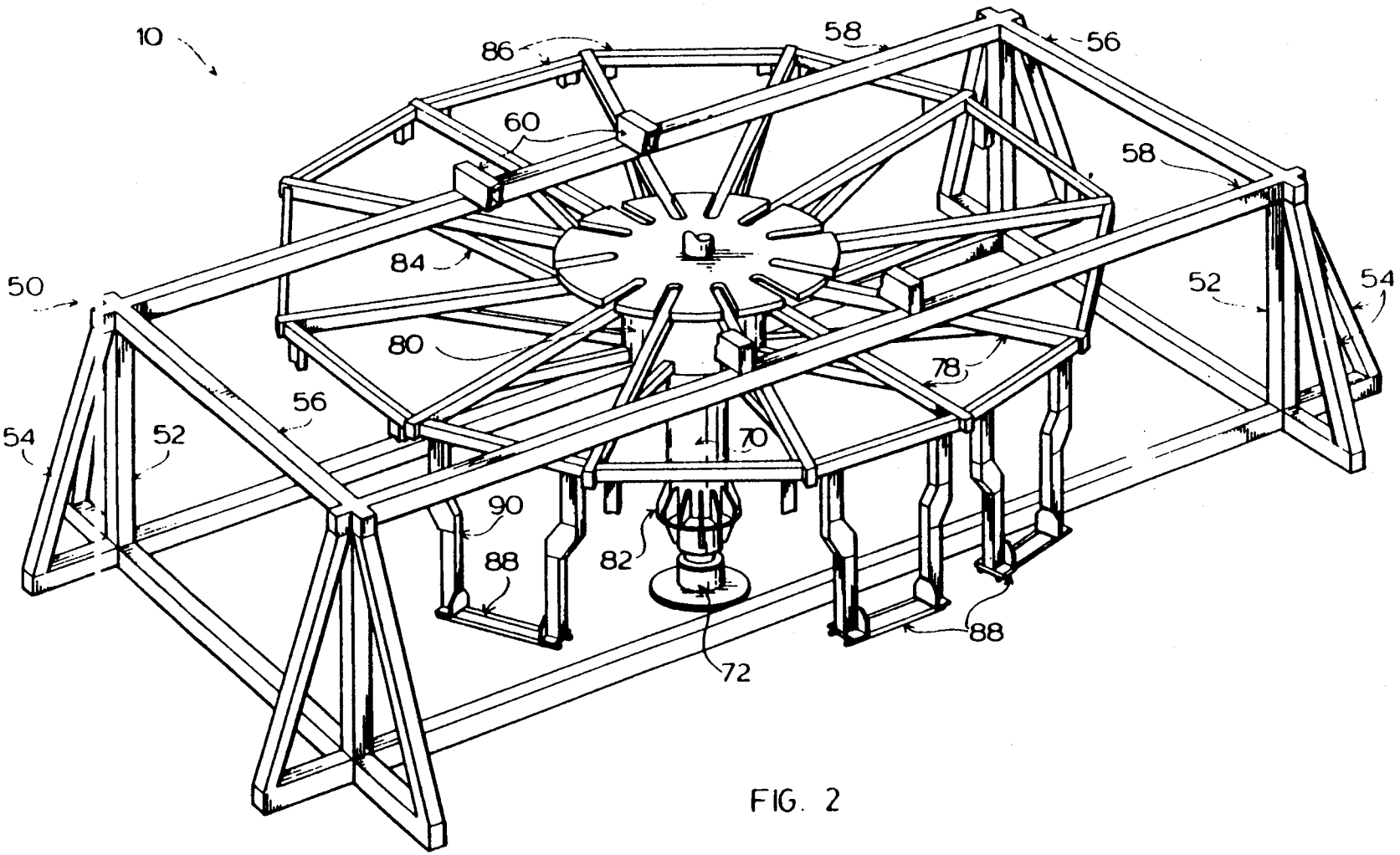
FIG. 2 is a perspective view of the frame of the carousel apparatus.
Figure 3:
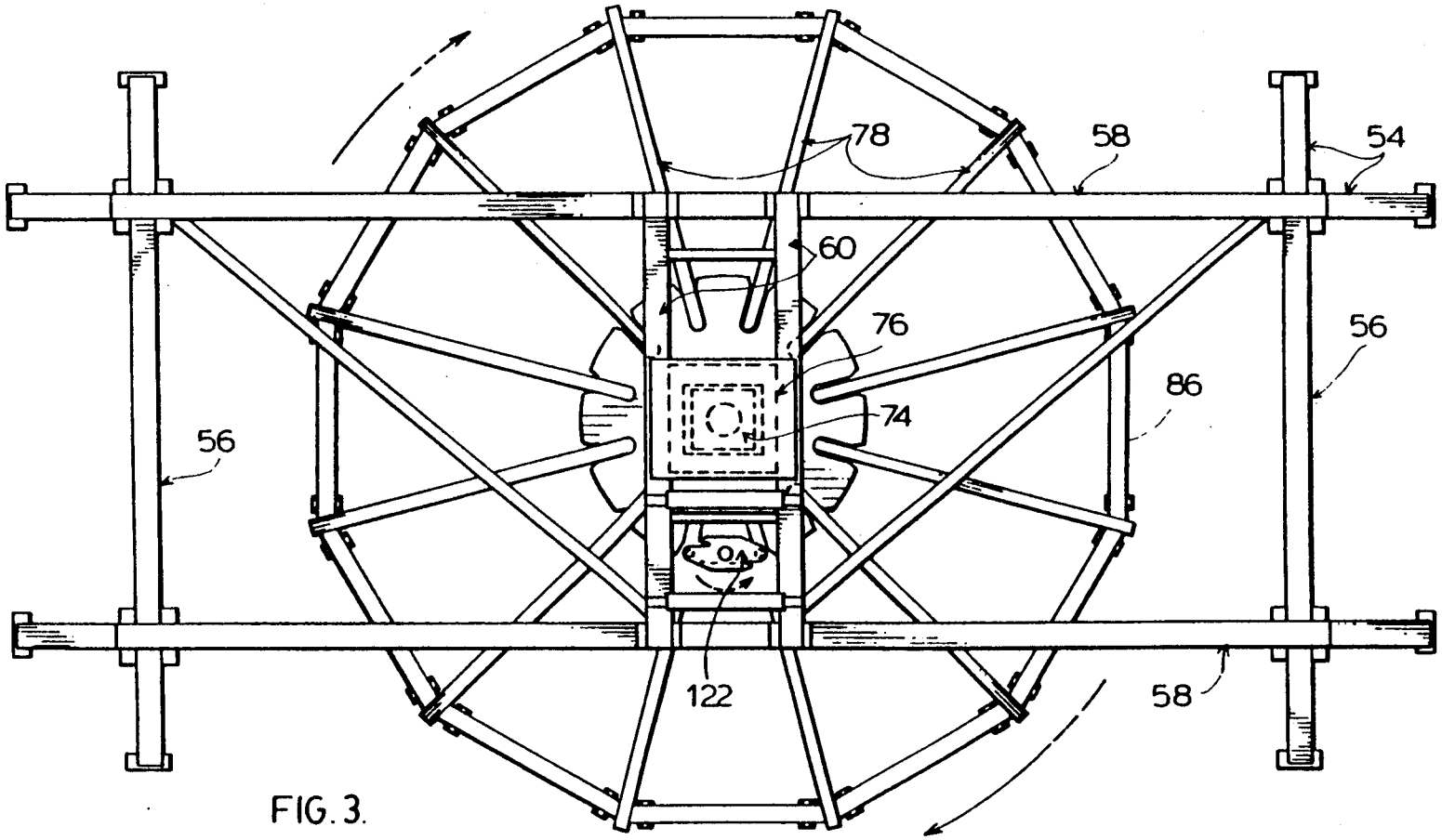
FIG. 3 is a plan view of the carousel apparatus shown in FIG. 2 illustrating the drive mechanism.
Figure 4:
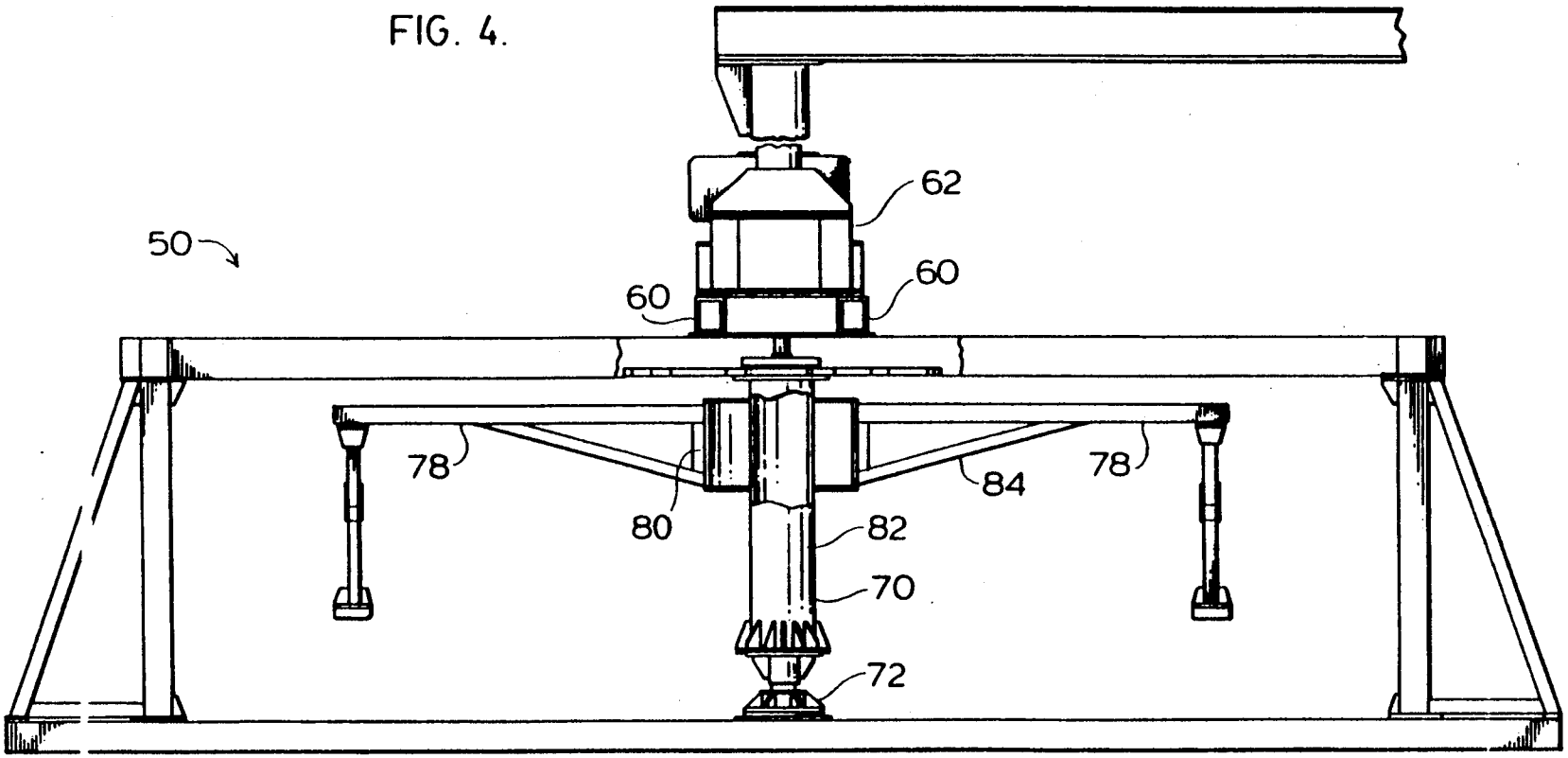
FIG. 4 is a side elevation, partly cut away, of the carousel assembly shown in FIG. 3.

Radial beams 78 secured at their inner ends to collar 80, which in turn is secured to a column 82 forming part of shaft 70, are supported by diagonal struts 84 extending between the base of collar 80 and an intermediate point on radial beams 78. Peripheral beams 86 interconnect the outer ends of beams 78 to define a side of the multi-sided carousel and support an equal number of cathode hangers 88, three of which are shown in FIG. 2.

Each cathode hanger 88, details for which are shown in FIG. 7, comprises downwardly extending side-arms 90 rigidly interconnected to beams 86 by plates 92 welded thereto. An L-shaped hanger bracket 94 welded to the inner side of each of arms 90 is adapted to receive hanger bar 96 secured to the top edge of cathode 98, shown by ghost lines. Cathode 98 and its construction are disclosed in detail in applicant's U.S. Pat. No. 4,882,027.

A pair of spaced apart transverse rods 100 are mounted for rotation in bushings 102 rigidly secured to the underside of arms 90 to carry V-support 104. Each V-support 104 comprises a pair of opposed upper plates 106 rigidly interconnected to their respective transverse rods 100 by spaced apart plates 108, for reasons which will become apparent as the description proceeds.

It will be observed that the conterminous bottom edges 110 of cathode 98 and metallic sheets 112, 114 are positioned a short distance above V-support 104.

Figure 5:
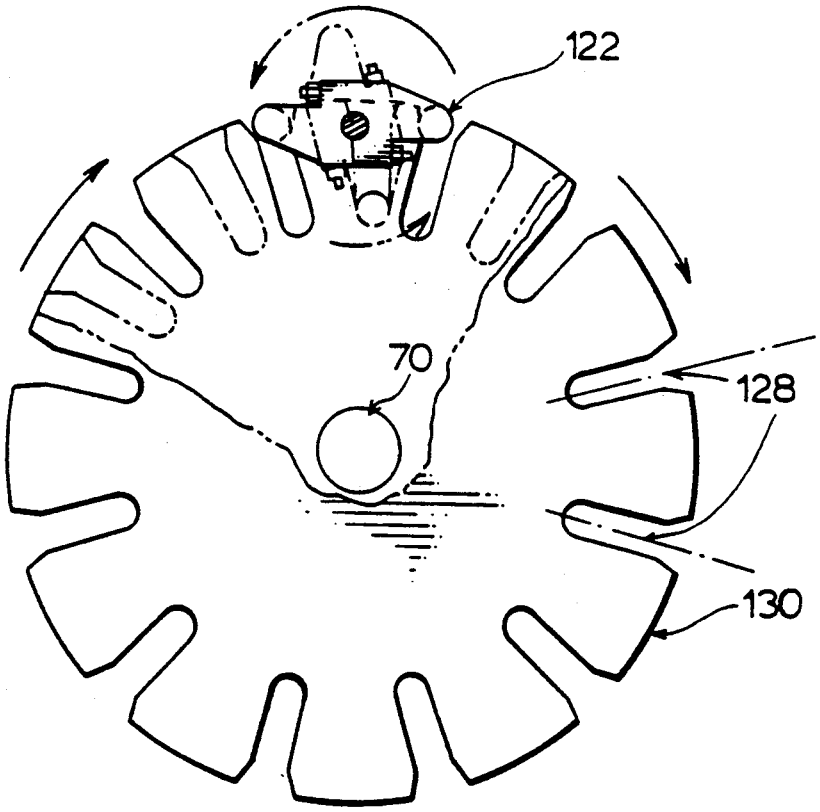
FIG. 5 is an enlarged plan view, partly cut away, of the drive mechanism of the invention showing partial rotation thereof by ghost lines.
Figure 6:
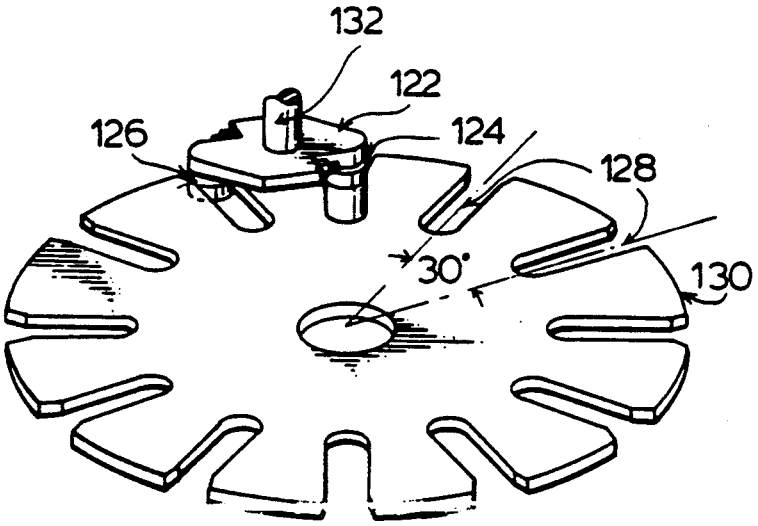
FIG. 6 is a perspective view of the drive mechanism shown in FIG. 5.

The carousel 10 is driven in a clockwise direction, as viewed in FIGS. 5 and 6 of the drawings, by a Geneva-type indexing drive assembly 62 which comprises an hydraulic motor 120 driving via a counter-clockwise rotating shaft 132 a torque arm drive 122 having a pair of downwardly extending roller subshafts 124, 126, engaging into radial slots 128 formed in the Geneva drive wheel 130, as shown most clearly by the ghost lines in FIG. 5. The Geneva drive wheel 130 has twelve radial slots 128 spaced 30° apart, one for each of the twelve station locations, to permit accurate inexing of a cathode hanger on the carousel into each station. At the time when both rollers 124, 126 are in contact with consecutive slots, the wheel 130 and consequently the entire carousel assembly, are stationary. At these junctures, the cathode hangers are correctly positioned within a station and the drive 120 is stopped for a predetermined period of time to allow the desired functions to occur at the plurality of stations.

THE LOADING STATION

Cathodes 98 having metallic sheets 112, 114 are transferred sequentially onto a cathode hanger assembly 88 at loading station 14. Hanger bar 96 is supported at each end in hanger brackets 94 with bottom edges 110 suspended above V-support 104. The transfer of a cathode 98 onto hanger brackets preferably is completed in about 2.5 seconds within a minimum cycle time at each station of about 4.5 seconds, thus allowing about 2.0 seconds for transfer to and indexing of the cathode hanger and cathode at the next station. Cathode 98 is then advanced to hammering station 16 by rotation of drive assembly 62 for breaking the adhesion of the upper edges of the deposited metal sheets to the cathode.

THE HAMMERING STATION

Figure 8:
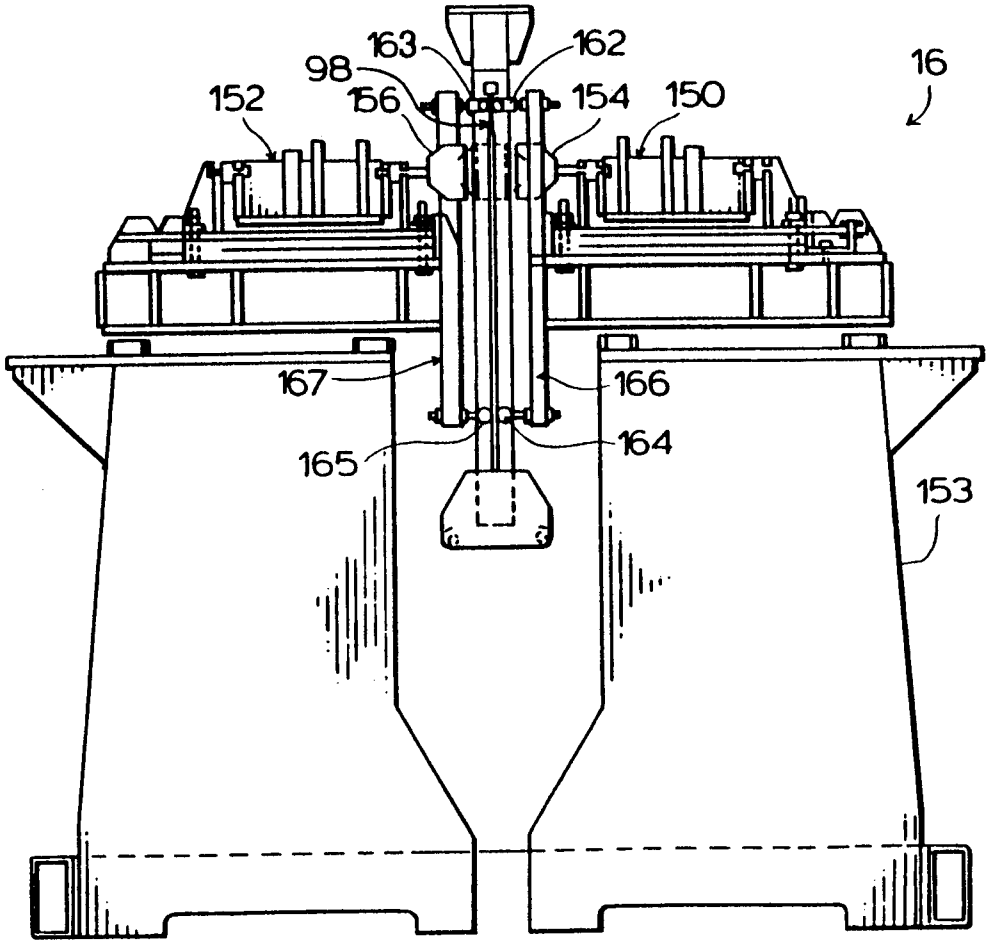
FIG. 8 is an end elevation of a cathode in an operative position at a hammering station.

Turning now to FIGS. 8 and 9, hammering station 16 comprises a pair of opposed, reciprocally mounted carriages 150, 152 mounted on frame 153 adapted to be extended towards and retracted away from cathode 98 such that opposed air hammers 154, 156 supported thereby will, upon actuation, strike metallic sheets 112, 114 on cathode 98 in proximity to the upper edges 158, 160 of the sheets. Upper pair of opposed clamps 162, 163 mounted on vertical support members 166, 167, carried by carriages 150, 152, about the upper end of cathode 98 during the hammering operation while the lower pair of opposed clamps 164, 165 grip the lower portions of sheets 112, 114 therebetween to ensure the metallic sheets are not prematurely dislodged from the cathode. In the preferred operation, the striking surfaces of the hammers are composed of steel and the hammers are driven by a common air-cylinder such that their striking action follows a random pattern.

THE OPENING STATION

Figure 10:
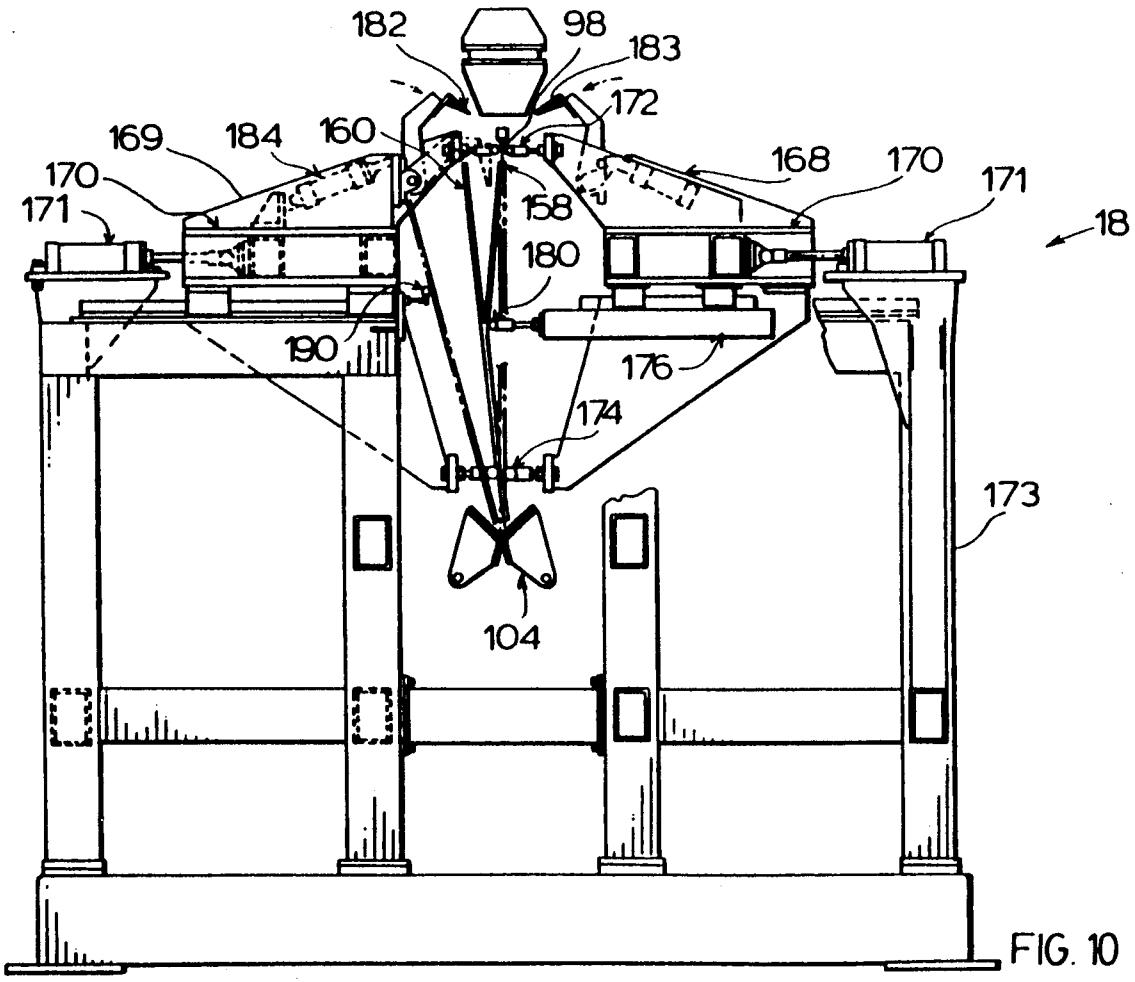
FIG. 10 is an end elevation of a cathode in its operative position at the opening station.
Figure 11:
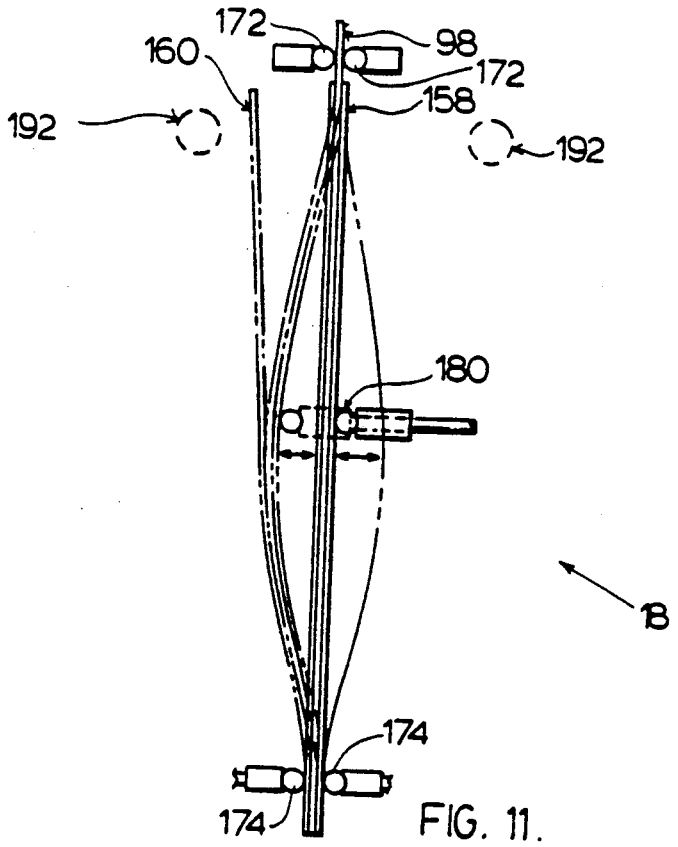
FIG. 11 is an enlarged end elevation of a cathode at the opening station.
Figure 12:
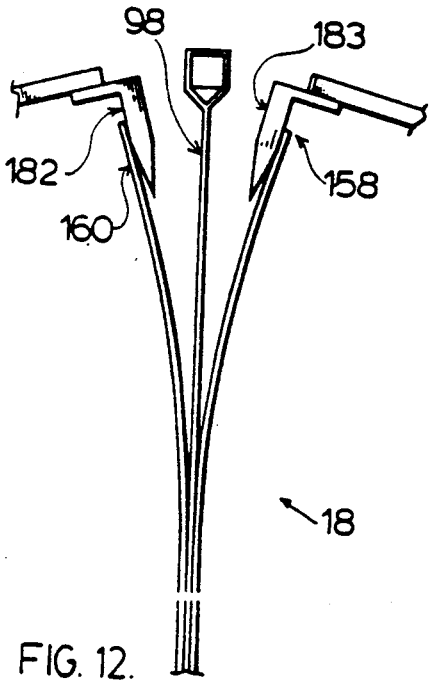
FIG. 12 is an end elevation of an upper portion of a cathode at the opening station illustrated in FIGS. 10 and 11 showing the interaction of grippers with the upper edges of the metallic sheets.

The hammering operation normally releases the upper edges 158, 160 of the metallic sheets from cathode 98 whereby flexing of the cathode, shown in FIGS. 10–12, at the opening station 18 frees one upper edge 160 and then the second upper edge 158 from cathode 98. With particular reference to FIG. 10, the opening station 18 comprises a pair of opposed carriages 168, 169 each mounted for reciprocal travel towards each other and away from each other on guide frame 170 by the actuation of piston-cylinder assemblies 171 mounted on frame 173. The right hand portion of the figure shows polyurethane-covered upper clamp 172 adapted to rigidly engage the upper portion of cathode 98 above the upper edges 158, 160 of the metallic sheets and lower steel clamps 174 adapted to engage the lower extremity of cathode 98 and metal sheets 112, 114 immediately above V-support 104. Piston cylinder assembly 176, carried by carriage 168, unit 164 permits initial extension of central push bar 180 to the position depicted in FIG. 10, and by ghost lines in FIG. 11, thereby bending the cathode to separate loosened upper edge 160 from cathode 98. The deflection of cathode 98 opens the upper edge 160 from cathode 98 a sufficient distance to allow the insertion of finger 182 on the side opposite to bar 180 into the said opening by actuation of piston-cylinder 184.

Piston-cylinder assembly 176 is then retracted and the procedure repeated on the opposite side of cathode 98 by actuating an opposite piston-cylinder assembly, not shown, to defect cathode 98 in the opposite direction for separation of the loosened upper edge 158 from cathode 98 to create an opening into which finger 183 is inserted in like manner, as illustrated in FIG. 12.

Upon completion of the insertion of the fingers 182, 183 into the gaps between upper edges 158, 160 and cathode 98, the fingers 182, 183 are retracted with carriages 168, 169 sequentially or simultaneously to at least partially and usually fully strip the metallic sheets from the cathode such that upper edges 158, 160 are bent outwardly of arcuate passive guides 192 which extend to the next station to engage and prevent said upper edges 158, 160 from returning to rest against cathode 98 during rotation and indexing of the carousel to the next station. Arcuate passive guides 190, one of which is shown, extend to the next station on each side of the cathode 98 to support the metallic sheets, as shown by ghost lines in FIG. 10, in the event a sheet is completely freed from the cathode as is normally the case.

OPTIONAL FULL-OPENING STATION

Figure 13:
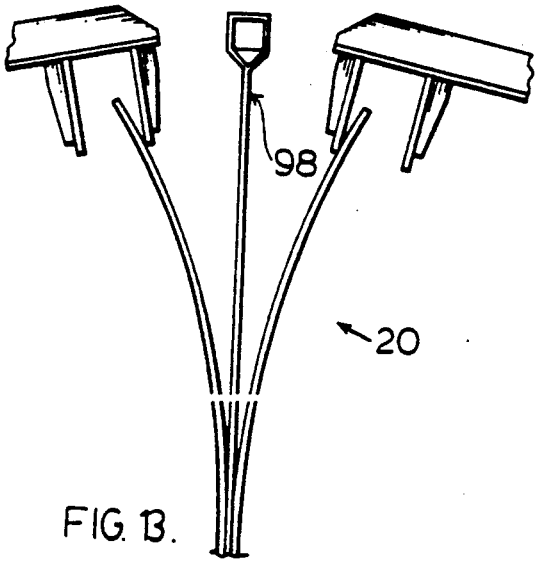
FIG. 13 is an end elevation of a cathode at an optional additional full-opening station depicted in FIG. 1 showing the partially separated metallic strips preparatory to stripping by peeling from the cathode when required.
Figure 14:
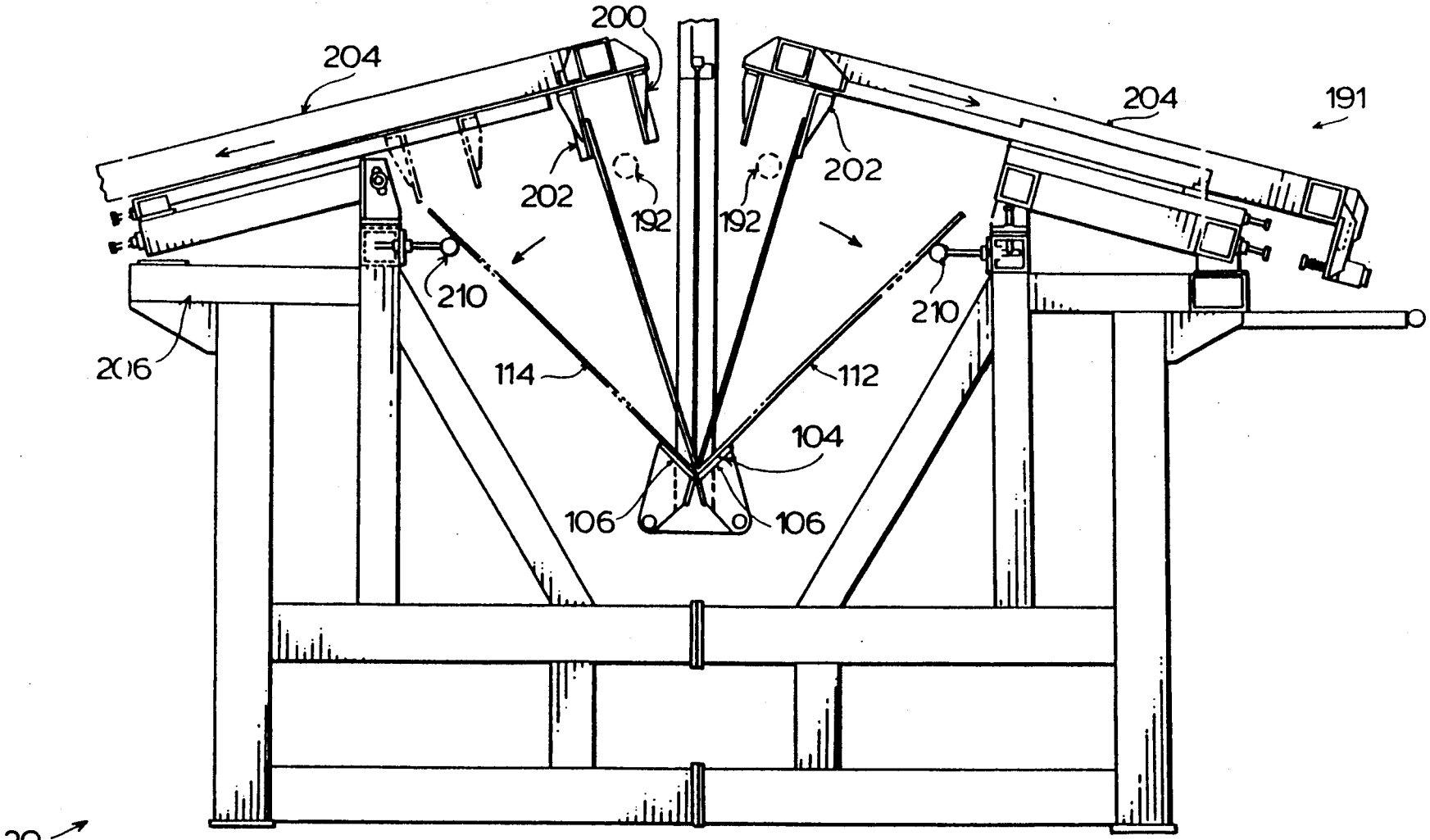
FIG. 14 is an end elevation of a cathode showing the pair of metallic strips fully detached from the cathode.

Turning now to FIGS. 13 and 14, in case of partial stripping only, the cathode with partially opened metallic sheets is next positioned at station 20 where a pair of opposed reciprocating carriages mounted on opposite side of the cathode are normally in an at-rest position with stripping fingers 200, 202 in position to receive the metallic sheets therebetween from the opening station. The fingers 200, 202 of each pair are supported a spaced distance apart on carriages 204 which are reciprocally mounted on frame 206 to peel the metallic sheets from the cathode upon retraction of the said fingers 200, 202. Inner finger 202, upon complete retraction of carriage 204 as shown by ghost lines in FIG. 14, is withdrawn sufficiently to allow metallic sheets 112, 114 to drop against the passive guide rails 210 which extend in an arc to the discharge station. The lower ends of metallic sheets 112, 114 normally have become detached from cathode 98 and drop onto the V-support 104, the angle sub-tended between plates 106 being about the same as the angle assumed between the metallic sheets fully opened.

OPTIONAL SEPARATION STATION

Figure 18:
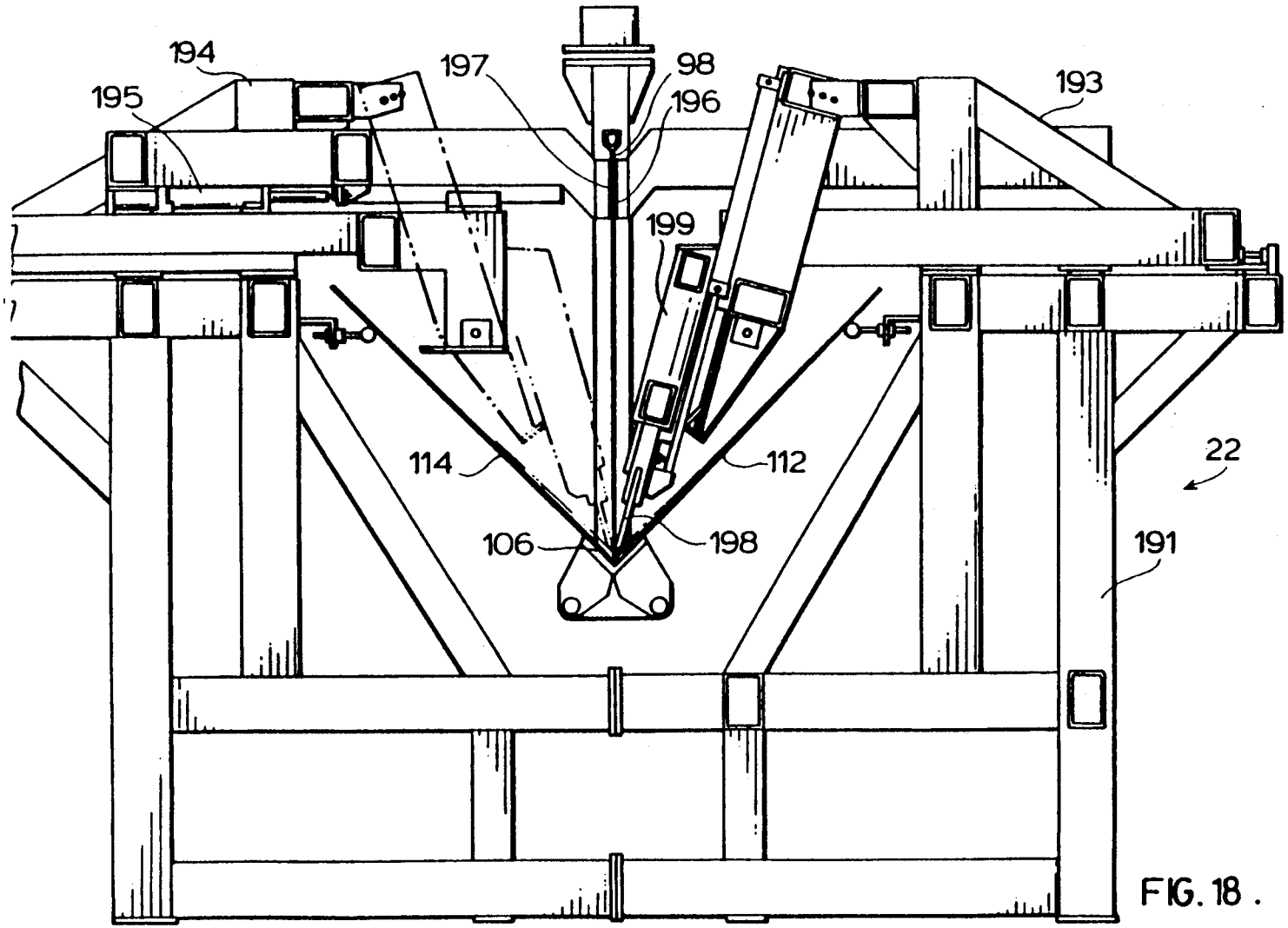
FIG. 18 is a side elevation of an optional separation station.

Separation station 22, which may be located after full-opening station 20, may be used for stripping of relatively flexible electrodeposited sheets such as thin copper sheets or zinc sheets which do not have the stiffness of normal thickness copper sheets. The separating mechanism at station 22 comprises frame 191 and carriages 193, 194 reciprocally mounted thereon for extension towards and retraction from cathode 98 by actuation of piston-cylinder assemblies 195, one of which is shown, whereby the upper end of partially stripped cathode 98 can be rigidly gripped between opposed clamps 196, 198. Polyethylene-coated knives 198 supported by piston-cylinder assembly 199, one of which is shown are then simultaneously lowered between the electrodeposited sheets and the cathode to complete stripping of the said sheets to the bottom of the cathode. This is illustrated in FIG. 18.

THE DISCHARGE STATION

Figure 15:
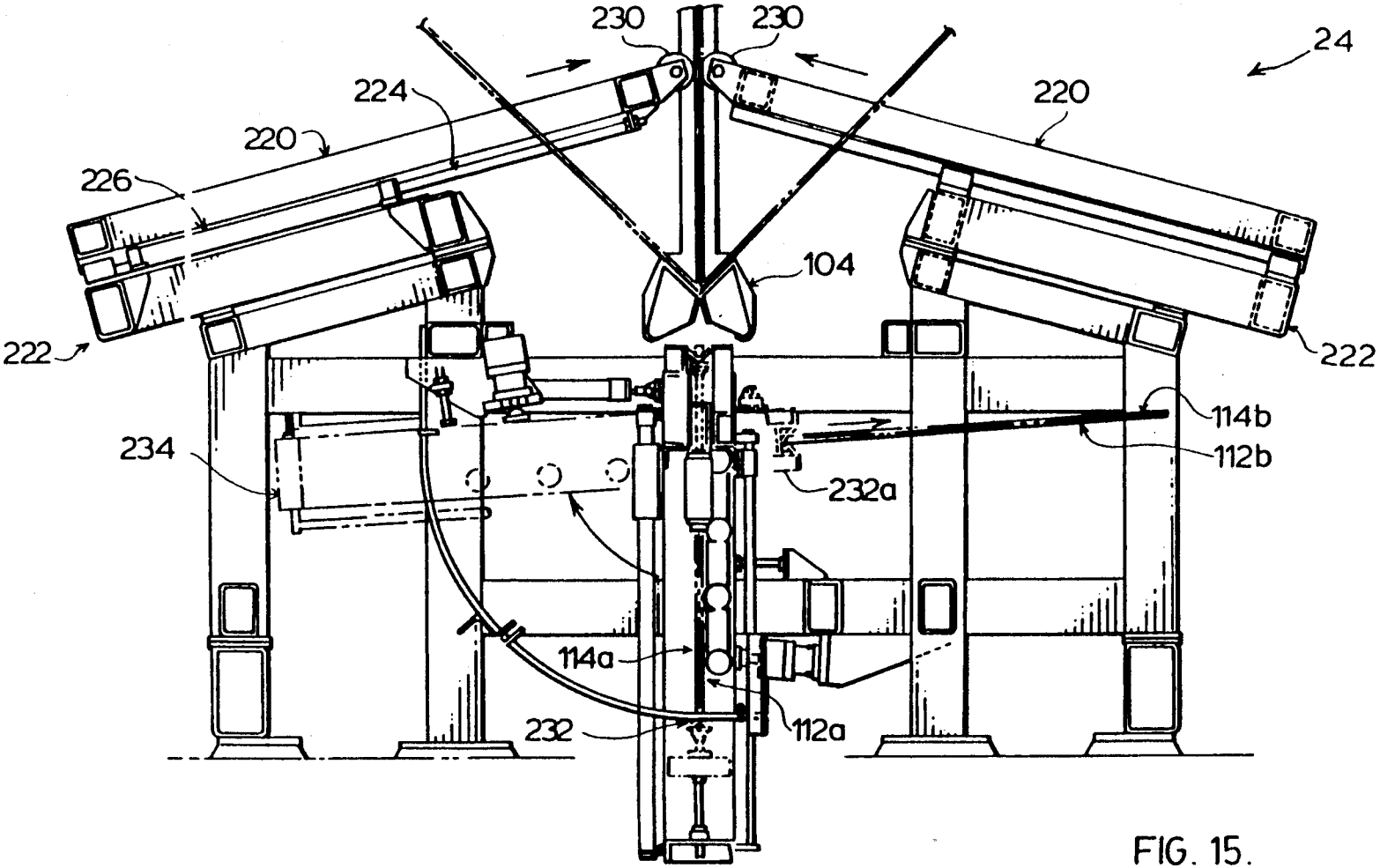
FIG. 15 is an end elevation of the lower portion of a cathode having the metallic sheets pivoted into abutment with the cathode preparatory to bottom discharge into the sheet rotator for substantially horizontal discharge.
Figure 16:
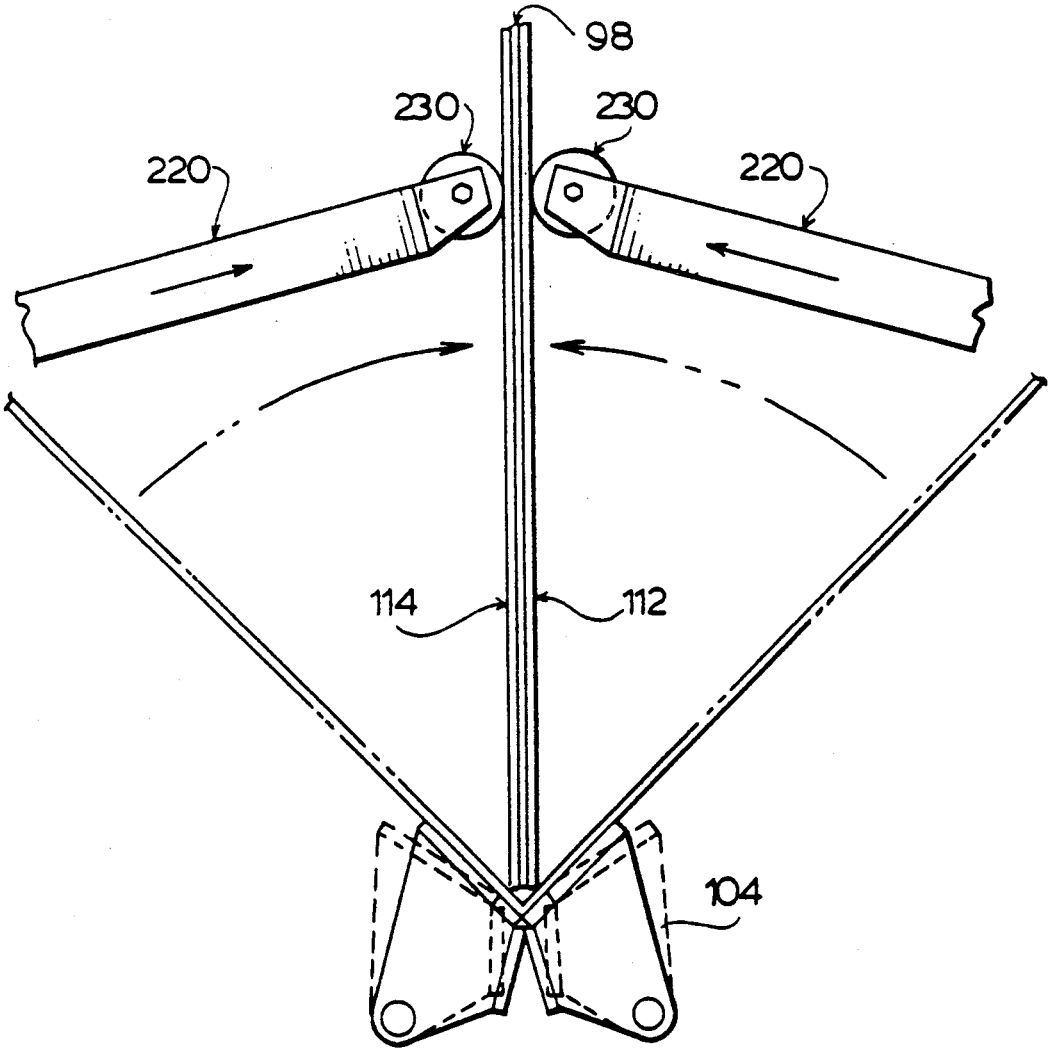
FIG. 16 is an enlarged end elevation of a cathode with metallic sheets pivoted thereagainst, as shown in FIG. 15, indicating opening of the bottom V-support by ghost lines.

Cathodes 98 having metallic sheets 112, 114 separated therefrom and supported by V-support 104 are indexed to discharge station 24, shown more clearly in FIG. 15, for horizontal discharge from the stripping apparatus. Station 24 comprises a pair of opposed hydraulic rams 220 mounted for extension and retraction on support frames 222 and each actuated by piston 224 extending from cylinder 226. Stripped metallic sheets 112, 114 are pushed from the spread-apart position shown by ghost lines in FIGS. 15 and 16 to loose abutment against cathode 98 for vertical alignment followed by opening of V-support 104, as illustrated by the ghost lines in FIG. 16 by rotation of rods 100 and pivoting of plates 106 away from each other by actuating means, not shown, located at station 24. Metallic strips 112, 114 fall by gravity vertically to the position designated by 112*a*, 114*a* shown in FIG. 15 under the guidance of opposed rollers 230 journaled at the ends of rams 220. Lower support assembly or envelope 232 is rotated through about 90° in a clockwise direction as viewed in FIG. 15 to the position depicted by ghost lines 232*a* and the pair of abutting metallic sheets ejected by hydraulic ram 234 to the position depicted by numerals 112*b*, 114*b* for discharge onto a shuttle conveyor.

The stripped cathode may then be indexed through inspection station 25 to a reject and replacement station 26 for substitution of damaged cathodes.

The carousel is then indexed to a cathode unloading station 28 for sequential loading and discharge of the cathodes onto a chain conveyor for accumulation of a full load of cathodes for removal from the stripping assembly and transfer to a tankhouse for reuse.

THE BUNDLING STATION

The stripped metallic sheet travels in pairs from the discharge station 24 by means of a shuttle conveyor onto a 100 tonne corrugating press 250. Every second pair of metallic sheets is corrugated and the alternate corrugated and planar pairs of sheets moved onto a set of trip rolls which deposits the sheets onto a stacker lift 252 at the cycle rate of about 4.5 seconds per double sheet.

Figure 17:
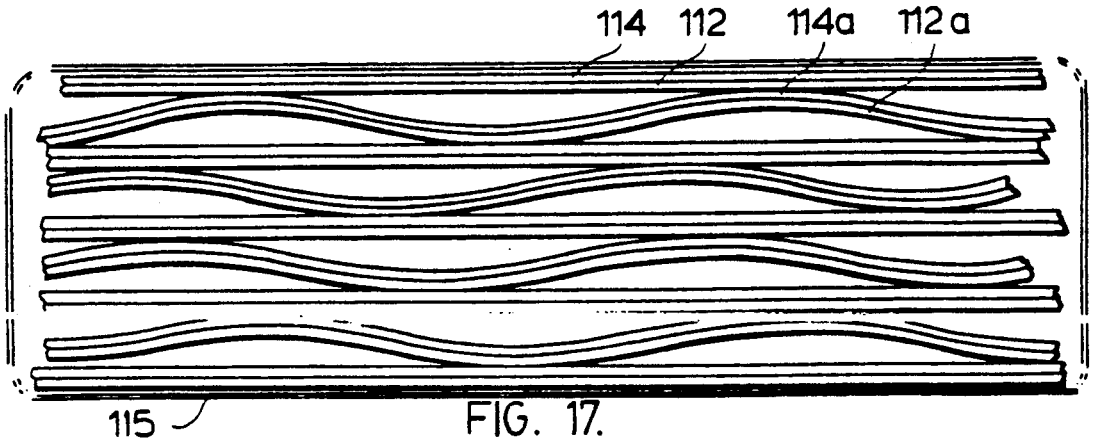
FIG. 17 is an end elevation, partly cut away, of a portion of a stack of alternate corrugated and uncorrugated pairs of metallic sheets, with strapping.

The stacker lift 252 comprises a lowering assembly which lowers the bundle as it is formed so that the distance between the trip rolls and the top of the bundle remains constant. When the required quantity of pairs of metallic sheets, i.e. planar sheets 112, 114 and corrugated sheets **112*a* and 114*a* as typified in FIG. 17, has been attained to form a bundle, e.g. approximately 3 tonnes, the bundle is lowered on to a chain conveyor 254 for transfer to weight lift 256 and strapper lift 258**. The lowering assembly is returned to its uppermost position to receive pairs of metallic sheets for the next bundle.

After weighing of the bundle by conventional weighing equipment at lift 256, the bundle normally is placed on a pair of wood blocks, not shown, and compressed prior to wrapping and clamping steel straps 115 about the bundle.

The present invention provides a number of important advantages. Cathodes such a stainless steel cathodes having copper sheets electrodeposited thereon can be quickly and positively stripped of the sheets without damage to the cathodes or sheets permitting an effective and reliable operation. Automation of the operation minimizes or eliminates manual operations to increase rate of productivity while obviating many hazards. The carousel configuration minimizes space requirements for important savings in construction costs.

The bundles of product metallic sheet stacked and bound in alternate layers of pairs of corrugated and uncorrugated or planar sheets provide continuous elongated air gaps extending from one end of the bundle to other to enhance the rate of heat transfer in a subsequent melting operation. Such bundle represents a novel product.

It will be understood, of course, that modifications can be made in the embodiment of the invention illustrated and described herein without departing from the scope and purview of the invention as defined by the appended claims.

I claim:

1. Apparatus for stripping electrodeposited metal sheets from cathodes comprising a carousel mounted for rotation through 360°, means for charging said cathodes one by one onto the carousel and support them vertically at the periphery of said carousel, a plurality of stations located at the periphery of the carousel for subjecting said cathodes to various operations required to strip the electrodeposited metal from the cathodes and means for sequentially advancing the cathodes through said stations and subjecting them to the operations required to strip the same and discharge the stripped sheets and then the cathodes from the carousel.

2. Apparatus according to claim 1, in which said stations include a loading station for receiving the cathodes having electrodeposited sheets thereon, a hammering station for loosening the upper edges of said electrodeposited sheets from the cathodes, an opening station for forming gaps between the loosening upper edges of said electrodeposited sheets and the cathodes and for stripping said sheets from the cathodes, a discharge station for discharge of electrodeposited sheets and an unloading station for removal of stripped cathodes.

3. An apparatus as claimed in claim 2, in which the carousel is multi-sided and said means on the carousel for supporting said cathodes having electrodeposited sheets thereon comprises a pair of downwardly extending side arms spaced apart to receive a cathode therebetween secured to the carousel at each of said sides, a hanger bracket secured to each side arm in proximity to its upper end for support the hanger bar of a cathode, a V-support having an apex secured at opposite ends to the lower ends of the pair of side arms below the bottom of a cathode, and means for opening the V-support.

4. An apparatus as claimed in claim 2, which additionally comprises a full-opening and/or a separation station between the opening station and the discharge station for ensuring completion of stripping of electrodeposited metal sheets from the cathodes prior to discharge.

5. An apparatus as claimed in claim 2, in which the hammering station comprises a pair of opposed, reciprocally mounted carriages, each having a plurality of air hammers, one on each side of the cathode, adapted to be extended towards and retracted away from the cathode whereby the air hammers strike the electrodeposited sheets in proximity to upper edges of said sheets for loosening of said upper edges.

6. An apparatus as claimed in claim 2, in which the opening station comprises a pair of opposed, reciprocally mounted carriages on each side of the cathode each having an upper clamp for abutting the cathode above the upper edge of the electrodeposited sheet and a lower clamp for abutting the electrodeposited sheet in proximity to its lower edge, a central push bar having piston-cylinder assembly operatively connected thereto for independent actuation and a downwardly depending finger pivotally mounted at the top of the carriage, whereby the cathode can be rigidly clamped between the upper clamps and the electrodeposited sheets in proximity to their lower ends, clamped by the lower clamps upon extension of the carriages towards each other, and flexed in a first direction by extending a first push bar to form a gap between the upper edge of the electrodeposited sheet and cathode on the opposite side of the first push bar and insertion of at least on finger into said gap, and then flexed in the opposite direction by retracting the first push bar and extending the second push bar to form a gap between the upper edge of the electrodeposited sheet and the cathode on the opposite side of the second push bar and insertion of at least one finger into said gap, retracting the second push bar and retracting the carriages with the fingers to strip the electrodeposited sheets from the cathode.

7. An apparatus as claimed in claim 2, in which said discharge station is a bottom discharge station for discharging pairs of metallic sheets, and means are provided in said bottom discharge station for receiving pairs of vertically-aligned metallic sheets, for rotating said pairs of vertically-aligned metallic sheets to a horizontal position, and for discharging said pairs of metallic sheets horizontally from the carousel.

8. An apparatus as claimed in claim 2, additionally comprising means for corrugating alternate pairs of metallic sheets, means for stacking said alternate pairs of corrugated and uncorrugated sheets, and means for bundling said stack.

* * * * *